US008655518B2

(12) United States Patent
Cooper et al.

(10) Patent No.: US 8,655,518 B2
(45) Date of Patent: Feb. 18, 2014

(54) TRANSPORTATION NETWORK SCHEDULING SYSTEM AND METHOD

(75) Inventors: Jared Cooper, Melbourne, FL (US); Joseph Noffsinger, Grain Valley, MO (US); Ajith Kuttannair Kumar, Erie, PA (US); Mason Samuels, Melbourne, FL (US); Paul Houpt, Niskayuna, NY (US); Joel Kickbusch, Melbourne, FL (US); Mahir Telatar, Melbourne, FL (US); David Eldredge, Melbourne, FL (US); Mitchell Scott Wills, Melbourne, FL (US); Ramu Chandra, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 91 days.

(21) Appl. No.: 13/311,759

(22) Filed: Dec. 6, 2011

(65) Prior Publication Data

US 2013/0144466 A1 Jun. 6, 2013

(51) Int. Cl.
*G05D 1/00* (2006.01)

(52) U.S. Cl.
USPC ..... 701/19; 701/465; 340/994

(58) Field of Classification Search
USPC ..... 701/2, 465, 411, 19, 117, 400; 340/994
See application file for complete search history.

(56) References Cited

U.S. PATENT DOCUMENTS 5,177,684 A * 1/1993 Harker et al. ..... 701/117
5,623,413 A * 4/1997 Matheson et al. ..... 701/117
5,794,172 A * 8/1998 Matheson et al. ..... 701/117
5,828,979 A * 10/1998 Polivka et al. ..... 701/117
6,135,396 A * 10/2000 Whitfield et al. ..... 246/182 R
6,154,735 A * 11/2000 Crone ..... 706/45
6,304,801 B1 * 10/2001 Doner ..... 701/19
6,459,964 B1 * 10/2002 Vu et al. ..... 701/19
7,395,141 B1 7/2008 Seck et al.
7,500,436 B2 3/2009 Kumar et al.
7,512,481 B2 3/2009 Julich et al.
7,618,011 B2 11/2009 Oleski et al.
7,669,534 B2 3/2010 Kumar et al.
7,680,750 B2 3/2010 Daum et al.
7,715,958 B2 5/2010 Kumar (Continued)

FOREIGN PATENT DOCUMENTS

WO 2004059446 A2 7/2004

OTHER PUBLICATIONS

Search Report and Written Opinion from corresponding PCT Application No. PCT/US2012/062037 dated Feb. 12, 2013.

*Primary Examiner* — Thomas Black
*Assistant Examiner* — Shardul Patel
(74) *Attorney, Agent, or Firm* — GE Global Patent Operation; John A. Kramer

(57) ABSTRACT

A system includes a scheduling module and a resolution module. The scheduling module determines plural initial schedules for plural different vehicles to concurrently travel in a transportation network. The initial schedules include locations and times for the vehicles to travel. The resolution module modifies at least one of the initial schedules to one or more modified schedules based on an anomaly in at least one of the vehicles or the routes that prevents one or more of the vehicles from traveling in the transportation network according to the initial schedules. The scheduling module communicates the modified schedules to the vehicles so that energy management systems disposed on the vehicles modify travel of the vehicles according to the modified schedules.

37 Claims, 5 Drawing Sheets

(56) References Cited

U.S. PATENT DOCUMENTS

| | | | | |
|---|---|---|---|---|
| 7,715,977 | B2 | 5/2010 | Julich et al. | |
| 7,725,249 | B2 | 5/2010 | Kickbusch et al. | |
| 7,734,383 | B2 | 6/2010 | Philp et al. | |
| 7,797,088 | B2 | 9/2010 | Philp et al. | |
| 7,813,846 | B2 | 10/2010 | Wills et al. | |
| 7,882,789 | B2 | 2/2011 | Kumar et al. | |
| 7,937,193 | B2 | 5/2011 | Philp et al. | |
| 7,974,774 | B2 | 7/2011 | Kumar | |
| 8,025,115 | B2 | 9/2011 | King et al. | |
| 2006/0074544 | A1* | 4/2006 | Morariu et al. | 701/117 |
| 2007/0219681 | A1* | 9/2007 | Kumar et al. | 701/19 |
| 2008/0109124 | A1 | 5/2008 | Daum et al. | |
| 2008/0201027 | A1 | 8/2008 | Julich et al. | |
| 2008/0288132 | A1 | 11/2008 | King et al. | |
| 2009/0037039 | A1 | 2/2009 | Yu et al. | |
| 2009/0099825 | A1 | 4/2009 | Bollapragada et al. | |
| 2009/0118970 | A1 | 5/2009 | Daum et al. | |
| 2009/0132113 | A1 | 5/2009 | Kumar et al. | |
| 2009/0254233 | A1 | 10/2009 | Noffinger et al. | |
| 2010/0019726 | A1 | 1/2010 | Kumar | |
| 2010/0023190 | A1 | 1/2010 | Kumar et al. | |
| 2010/0043388 | A1 | 2/2010 | Mason et al. | |
| 2010/0150705 | A1 | 6/2010 | Mason et al. | |
| 2010/0153419 | A1 | 6/2010 | Daum et al. | |
| 2010/0163687 | A1 | 7/2010 | Brand et al. | |
| 2010/0185472 | A1 | 7/2010 | Goodermuth et al. | |
| 2010/0241295 | A1 | 9/2010 | Cooper et al. | |
| 2011/0051663 | A1 | 3/2011 | Cooper et al. | |
| 2011/0060486 | A1 | 3/2011 | Meltser et al. | |
| 2011/0099413 | A1 | 4/2011 | Cooper et al. | |
| 2011/0106327 | A1 | 5/2011 | Zhou et al. | |
| 2011/0106328 | A1 | 5/2011 | Zhou et al. | |

* cited by examiner

TRANSPORTATION NETWORK SCHEDULING SYSTEM AND METHOD

CROSS-REFERENCE TO RELATED APPLICATIONS

This application is related to co-pending U.S. patent application Ser. No. 13/311,807, which was filed on Dec. 6, 2011, is titled "Transportation Network Scheduling System And Method," (referred to herein as the "'807 application"), and U.S. patent application Ser. No. 13/311,977, which was filed on Dec. 6, 2011, is titled "System And Method For Allocating Resources In a Network". The entire disclosures of the '807 application and the '977 applications are incorporated by reference.

TECHNICAL FIELD

Embodiments of the invention relate to scheduling systems for vehicles traveling in a transportation network.

BACKGROUND

A transportation network for vehicles can include several interconnected main routes on which separate vehicles travel between locations. For example, a transportation network may be formed from interconnected railroad tracks with rail vehicles traveling along the tracks. The vehicles may travel according to schedules that dictate where and when the vehicles are to travel in the transportation network. The schedules may be predetermined in order to arrange for certain vehicles to arrive at various locations in the transportation network at desired times and/or in a desired order.

As the vehicles travel through the transportation network, unforeseen or unplanned events may occur. For example, vehicles may mechanically break down (and slow down to run at a reduced capacity or stop movement completely), sections of the routes in the transportation network may become damaged, additional vehicles may enter into or pass through the transportation network, and the like. These events may disrupt travel of the vehicles in the transportation network. As this travel is disrupted, traffic or congestion of the vehicles may increase, thereby decreasing the flow of vehicles in the transportation network.

If traffic or congestion of the vehicles in the transportation network increases, the vehicles may be forced to abruptly slow down or stop movement in order to avoid collisions with other vehicles or to avoid coming within a predetermined distance or buffer from other vehicles. Such slowing down or stopping can cause the vehicles to consume fuel in relatively inefficient manners, which can increase the amount of fuel consumed in order to get the vehicles to the scheduled locations.

A need exists for scheduling travel in transportation networks that can adapt to changing circumstances, such as the detection of events that disrupt the travel of vehicles in the transportation networks.

BRIEF DESCRIPTION

In one embodiment, a system (e.g., a transportation network scheduling system) includes a scheduling module and a resolution module. As used herein, the term "module" includes a hardware and/or software system that operates to perform one or more functions. For example, a module may include a computer processor, controller, or other logic-based device that performs operations based on instructions stored on a tangible and non-transitory computer readable storage medium, such as a computer memory. Alternatively, a module may include a hard-wired device that performs operations based on hard-wired logic of the device. The modules shown in the attached figures may represent the hardware that operates based on software or hardwired instructions, the software that directs hardware to perform the operations, or a combination thereof.

The scheduling module is configured to determine plural initial schedules for plural different vehicles to concurrently travel in a transportation network formed from a plurality of interconnected routes. The initial schedules include one or more locations and associated times for the vehicles to travel along the routes of the transportation network. The resolution module is configured to modify at least one of the initial schedules to one or more modified schedules based on an anomaly in at least one of the vehicles or the routes that prevents one or more of the vehicles from traveling in the transportation network according to one or more of the initial schedules associated with the one or more of the vehicles.

As used herein, the term "anomaly" or "anomalies" can refer to a condition or conditions of a vehicle and/or a route along which the vehicle is traveling or is scheduled to travel that an initial or previous schedule of the vehicle is not based on. An anomaly may be a condition of the vehicle and/or the route that prevents the vehicle from traveling to and arriving at a scheduled destination location at a scheduled arrival time. Non-exclusive examples of anomalies can include mechanical failure or need of repair of the vehicle and/or route, slow orders or areas of the transportation network where vehicles are required to reduce speed below an otherwise allowable speed of the same area of the transportation network, an addition of one or more other vehicles onto the transportation network where the schedule of the vehicle is not based on or does not account for the presence of the other vehicles in the transportation network, and the like.

The scheduling module is configured to communicate the one or more modified schedules to one or more of the vehicles so that energy management systems disposed on the one or more of the vehicles modify travel of the one or more vehicles in the transportation network according to the one or more modified schedules.

In another embodiment, another system (e.g., vehicle control system) includes an energy management module and a communication module. The energy management module is configured to generate an initial trip plan for a control unit of a first vehicle. As used herein, the term "first" is used to distinguish one vehicle from another vehicle. Thus, the term "first" does not necessarily mean that the first vehicle is in front of a group of mechanically linked vehicles and/or the first vehicle to perform a function or detect an event. The initial trip plan is based on an initial schedule of travel for the first vehicle in a transportation network formed from a plurality of interconnected routes. The initial trip plan is used by the control unit to control tractive efforts of the first vehicle in the transportation network. The communication module is configured to receive a modified schedule for travel of the first vehicle in the transportation network. The modified schedule is based on discovery of an anomaly in the transportation network that prevents the first vehicle from traveling in the transportation network according to the initial schedule. The energy management module is configured to change the initial trip plan to a modified trip plan based on the modified schedule and communicate the modified trip plan to the control unit to change the tractive efforts of the first vehicle.

In another embodiment, a method (e.g., method for network scheduling) includes determining plural initial schedules for plural different vehicles to concurrently travel in a transportation network formed from a plurality of interconnected routes. The initial schedules include one or more locations and associated times for the vehicles to travel along the routes of the transportation network. The method also includes identifying an anomaly in at least one of the vehicles or the routes that prevents one or more of the vehicles from traveling in the transportation network according to one or more of the initial schedules associated with the one or more of the vehicles and modifying at least one of the initial schedules to one or more modified schedules based on an anomaly. The method further includes communicating the one or more modified schedules to one or more of the vehicles so that energy management systems disposed on the one or more of the vehicles modify travel of the one or more vehicles in the transportation network according to the one or more modified schedules.

In another embodiment, another method (e.g., method for vehicle control) includes generating an initial trip plan for a control unit of a first vehicle. The initial trip plan is based on an initial schedule of travel for the first vehicle in a transportation network formed from a plurality of interconnected routes. The initial trip plan is used by the control unit to control tractive efforts of the first vehicle in the transportation network. The method also includes receiving a modified schedule for travel of the first vehicle in the transportation network. The modified schedule is based on discovery of an anomaly in the transportation network that prevents the first vehicle from traveling in the transportation network according to the initial schedule. The method further includes changing the initial trip plan to a modified trip plan based on the modified schedule. The modified trip plan used by the control unit to change the tractive efforts of the first vehicle.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the inventive subject matter described herein provide systems for modifying schedules of vehicles concurrently traveling in a transportation network when an anomaly is detected in the transportation network and/or when a previously detected anomaly in the transportation network is removed, repaired, or otherwise corrected. Systems for changing trip plans of the vehicles based on modified schedules of the vehicles also are provided. The trip plans may be changed so that the vehicles can adaptively modify tractive efforts, braking efforts, speeds, or the like, of the vehicles in order to arrive at a scheduled destination location while reducing the amount of fuel consumed by the vehicles.

Figure 1:
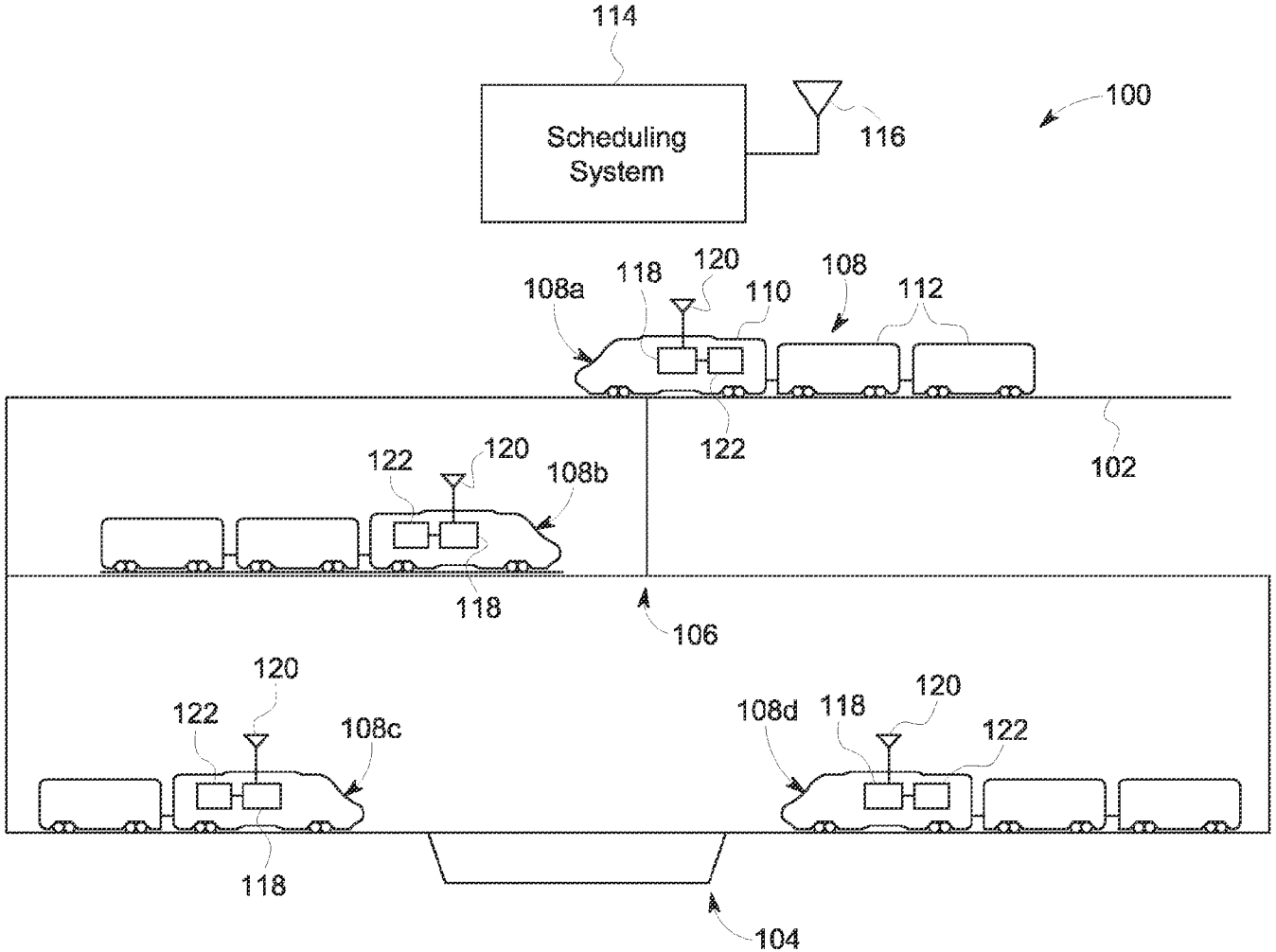
FIG. 1 is a schematic diagram of one embodiment of a transportation network.

FIG. 1 is a schematic diagram of one embodiment of a transportation network 100. The transportation network 100 includes a plurality of interconnected routes 102, such as railroad tracks, roads, or other paths across which vehicles travel. The transportation network 100 may extend over a relatively large area, such as hundreds of square miles or kilometers of land area. In the illustrated embodiment, the routes 102 include siding sections 104 to allow vehicles traveling along the same or opposite directions to pass each other. The routes 102 also include intersections 106 between different sections of the routes 102. The number of routes 102, siding sections 104, and intersections 106 shown in FIG. 1 is meant to be illustrative and not limiting on embodiments of the described subject matter. Moreover, while one or more embodiments described herein relate to a transportation network formed from railroad tracks, not all embodiments are so limited. One or more embodiments may relate to transportation networks in which vehicles other than rail vehicles travel.

Several vehicles 108 may concurrently travel along the routes 102 in the transportation network 100. In the illustrated embodiment, the vehicles 108 are shown and described herein as rail vehicles or rail vehicle consists. However, one or more other embodiments may relate to vehicles other than rail vehicles or rail vehicle consists. The vehicles 108 are individually referred to by the reference numbers 108*a*, 108*b*, 108*c*, and 108*d*. While four vehicles 108 are shown in FIG. 1, alternatively, a different number of vehicles 108 may be concurrently traveling in the transportation network 100. The term "vehicle" may refer to an individual component, such as an individual powered unit (e.g., a vehicle capable of self propulsion, such as a locomotive), an individual non-powered unit (e.g., a vehicle incapable of self propulsion, such as a cargo or rail car), a group of powered and/or non-powered units mechanically and/or logically linked together (e.g., a consist, train, or the like).

A vehicle 108 may include a group of powered units 110 (e.g., locomotives or other vehicles capable of self-propulsion) and/or non-powered units 112 (e.g., cargo cars, passenger cars, or other vehicles incapable of self-propulsion) that are mechanically coupled or linked together to travel along the routes 102. The routes 102 are interconnected to permit the vehicles 108 to travel over various combinations of the routes 102 to move from a starting location to a destination location.

The vehicles 108 travel along the routes 102 according to a movement plan of the transportation network 100. The movement plan coordinates movement of the vehicles 108 in the transportation network 100. For example, the movement plan may include schedules for the vehicles 108 to move from a starting location or a current location to a destination location at a scheduled arrival time. In one embodiment, the movement plan includes a list, table, or other logical arrangement of scheduled geographic locations (e.g., Global Positioning System coordinates) within the transportation network 100 and associated scheduled arrival times. The vehicles 108 move along various paths within the transportation network 100 to arrive at the scheduled locations at the associated scheduled arrival times. The scheduled locations in the movement plan can be referred to as "scheduled waypoints."

The movement plan may be determined by a scheduling system 114. As shown in FIG. 1, the scheduling system 114 can be disposed off-board (e.g., outside) of the vehicles 108. For example, the scheduling system 114 may be disposed at a central dispatch office for a railroad company. The scheduling system 114 can create and communicate the schedules to the vehicles 108. The scheduling system 114 can include a wireless antenna 116 (and associated transceiving equipment), such as a radio frequency (RF) or cellular antenna, that wirelessly transmits the schedules to the vehicles 108. For example, the scheduling system 114 may transmit destination locations and associated arrival times to the vehicles 108.

The vehicles 108 include control systems 118 disposed on-board the vehicles 108. The control systems 118 receive the schedules from the scheduling system 114 and generate control signals that may be used to control propulsion of the vehicles 108 through the transportation network 100. For example, the vehicles 108 may include wireless antennas 120, such as RF or cellular antennas, that receive the schedules from the scheduling system 114. On each vehicle, the wireless antenna 120 communicates the received schedule to the control system 118 that may be disposed on-board the vehicle 108. The control system 118 examines the schedule, such as by determining the scheduled destination location and scheduled arrival time, and generates control signals based on the schedule.

The control signals may be used to automatically control tractive efforts and/or braking efforts of the vehicle 108 such that the vehicle 108 self-propels along the routes 102 to the destination location. For example, the control system 118 may be operatively coupled with a propulsion subsystem 122 of the vehicle 108. The propulsion subsystem 122 may include motors (such as traction motors), engines, brakes (such as air brakes and/or regenerative brakes), and the like, that generate tractive energy to propel the vehicle 108 and/or slow movement of the vehicle 108. The control system 118 may generate control signals that automatically control the propulsion subsystem 122, such as by automatically changing throttle settings and/or brake settings of the propulsion subsystem 122.

In another embodiment, the control signals may be used to prompt an operator of the vehicle 108 to manually control the tractive efforts and/or braking efforts of the vehicle 108. For example, the control system 118 may include an output device, such as a computer monitor, touchscreen, acoustic speaker, or the like, that generates visual and/or audible instructions based on the control signals. The instructions may direct the operator to change throttle settings and/or brake settings of the propulsion subsystem 122.

As described below, the control system 118 may form a trip plan for a trip of the vehicle 108 to travel to a scheduled destination location at a scheduled arrival time. The trip plan may include throttle settings, brake settings, designated speeds, or the like, of the vehicle 108 for various sections of the trip of the vehicle 108. For example, the trip plan can include one or more velocity curves that designate various speeds of the vehicle 108 along various sections of the routes 102. The trip plan can be used by the control system 118 to determine the tractive efforts and/or braking efforts of the propulsion subsystem 122 for the trip. The control system 118 may form the control signals based on the trip plan.

In one embodiment, the trip plan is formed by the control system 118 to reduce an amount of fuel that is consumed by the vehicle 108 as the vehicle 108 travels to the destination location associated with the received schedule. The control system 118 may create a trip plan having throttle settings, brake settings, designated speeds, or the like, that propels the vehicle 108 to the scheduled destination location in a manner that consumes less fuel than if the vehicle 108 traveled to the scheduled destination location in another manner. As one example, the vehicle 108 may consume less fuel in traveling to the destination location according to the trip plan than if the vehicle 108 traveled to the destination location while traveling at another predetermined speed, such as the maximum allowable speed of the routes 102 (which may be referred to as "track speed"). The trip plan may result in the vehicle 108 arriving at the scheduled destination later than the scheduled arrival time. For example, following the trip plan may cause the vehicle 108 to arrive later than the scheduled arrival time, but within a predetermined range of time after the scheduled arrival time.

As the vehicles 108 travel in the transportation network 100, the vehicles 108 may encounter one or more anomalies. For example, the condition of a vehicle 108 may change (e.g., due to mechanical failure or a need for mechanical repair), the condition of a section of the route 102 over which the vehicle 108 is to travel may change (e.g., broken section of rail, a slow order is implemented, or the like), and/or one or more other vehicles 108 may enter into the transportation network 100 in such a manner as to impact the travel of the vehicle 108. The anomalies may negatively impact travel of the vehicles 108 according to the associated schedules. For example, with the presence or discovery of an anomaly, a vehicle 108 may be prevented from traveling to the scheduled destination location at the scheduled arrival time.

The anomaly may be discovered by or reported to the scheduling system 114. The scheduling system 114 can modify the schedules of one or more of the vehicles 108 in order to account for the anomaly. For example, the scheduling system 114 can change the scheduled destination location, the scheduled arrival time, and/or the path to be taken by a vehicle 108 during a trip. The scheduling system 114 may modify an initial schedule or a previous schedule that was formed without taking the anomaly into consideration into a modified schedule that takes the anomaly into consideration. For example, an initial schedule may have a scheduled arrival time that cannot be made by a vehicle 108 due to an anomaly while a modified schedule may include a later modified arrival time that can be made by the vehicle 108 even with the anomaly impeding travel of the vehicle 108.

The scheduling system 114 transmits one or more of the modified schedules to the vehicles 108. The control systems 118 receive the modified schedules and can adjust control of the vehicles 108 accordingly. For example, a control system 118 may receive a modified schedule, form a modified trip plan based on a modified arrival time and/or a modified destination location of the modified schedule, and generate control signals to implement the modified trip plan. The vehicle 108 may then travel in the transportation network 100 according to the modified schedule.

Figure 2:
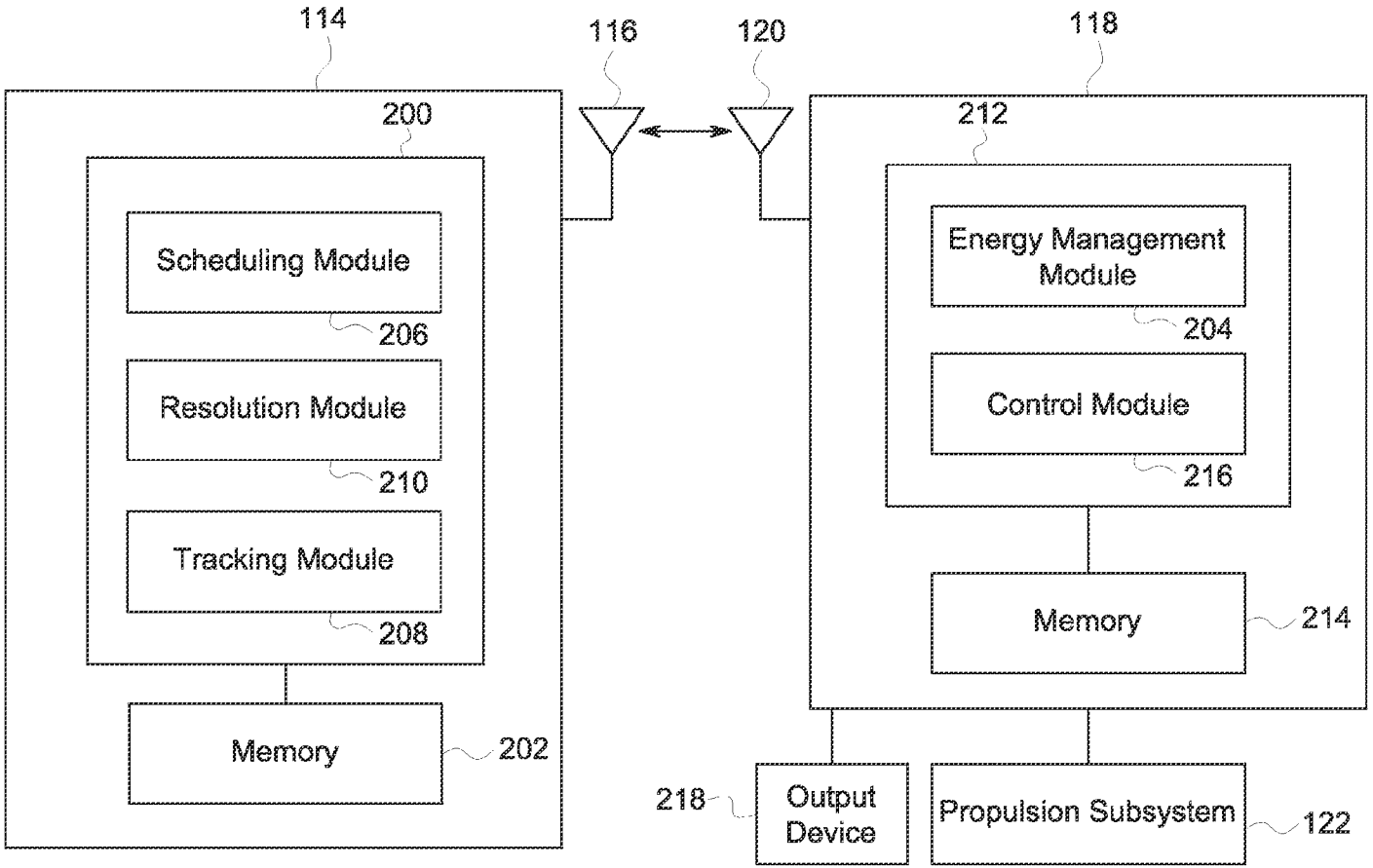
FIG. 2 is a schematic diagram of one embodiment of a scheduling system and a control system shown in FIG. 1.

FIG. 2 is a schematic diagram of one embodiment of the scheduling system 114 and the control system 118. While the scheduling system 114 is shown in FIG. 2 as communicating with a single control system 118, in one embodiment, the scheduling system 114 can concurrently communicate with two or more control systems 118 disposed on-board two or more different (e.g., not mechanically coupled with each other) vehicles 108 (shown in FIG. 1).

The scheduling system 114 includes a controller 200, such as a computer processor or other logic-based device that performs operations based on one or more sets of instructions (e.g., software). The instructions on which the controller 200 operates may be stored on a tangible and non-transitory (e.g., not a transient signal) computer readable storage medium, such as a memory 202. The memory 202 may include one or more computer hard drives, flash drives, RAM, ROM, EEPROM, and the like. Alternatively, one or more of the sets of instructions that direct operations of the controller 200 may be hard-wired into the logic of the controller 200, such as by being hard-wired logic formed in the hardware of the controller 200.

The scheduling system 114 includes several modules that perform various operations described herein. The modules are shown as being included in the controller 200. As described above, the modules may include hardware and/or software systems that operate to perform one or more functions, such as the controller 200 and one or more sets of instructions. Alternatively, one or more of the modules may include a controller that is separate from the controller 200.

The scheduling system 114 includes a scheduling module 206 that creates schedules for the vehicles 108 (shown in FIG. 1). In one embodiment, the scheduling module 206 controls communication between the scheduling system 114 and the vehicles 108. For example, the scheduling module 206 may be operatively coupled with the antenna 116 to permit the scheduling module 206 to control transmission of data (e.g., schedules) to the vehicles 108 and to receive data (e.g., trip plans, discovered anomalies, or the like) from the vehicles 108. Alternatively, another module or the controller 200 may be operatively coupled with the antenna 116 to control communication with the vehicles 108.

The scheduling module 206 creates schedules for the vehicles 108 (shown in FIG. 1). The scheduling module 206 can form the movement plan for the transportation network 100 (shown in FIG. 1) that coordinates the schedules of the various vehicles 108 traveling in the transportation network 100. For example, the scheduling module 206 may generate initial schedules for the vehicles 108 that are coordinated with each other. The term "initial" is not limited to just the first schedules generated for the vehicles 108. For example, an initial schedule can include any schedule that is later modified by the scheduling system 114, and may not necessarily be the first schedule created for a vehicle 108.

The initial schedules of the vehicles 108 (shown in FIG. 1) may be coordinated with each other by the scheduling module 206 in order to maintain one or more throughput parameters of the transportation network 100 (shown in FIG. 1). A throughput parameter can represent the flow or movement of the vehicles 108 through the transportation network 100 or a subset of the transportation network 100. In one embodiment, the throughput parameter can indicate how successful the vehicles 108 are in traveling according to the schedules associated with each of the vehicles 108. For example, the throughput parameter can be a statistical measure of adherence by one or more of the vehicles 108 to the schedules of the vehicles 108 in the movement plan. The term "statistical measure of adherence" can refer to a quantity that is calculated for a vehicle 108 and that indicates how closely the vehicle 108 is following the schedule associated with the vehicle 108. Several statistical measures of adherence to the movement plan may be calculated for the vehicles 108 traveling in the transportation network 100.

The throughput parameter may be based on or calculated from the statistical measures of adherence of the vehicles 108 (shown in FIG. 1). In one embodiment, larger throughput parameters represent greater flow of the vehicles 108 through the transportation network 100, such as what may occur when a relatively large percentage of the vehicles 108 adhere to the associated schedules and/or the amount of congestion in the transportation network 100 are relatively low. Conversely, smaller throughput parameters may represent reduced flow of the vehicles 108 through the transportation network 100. The throughput parameter may reduce in value when a lower percentage of the vehicles 108 follow the associated schedules and/or the amount of congestion in the transportation network 100 is relatively large.

The scheduling module 206 can create and coordinate the initial schedules of the vehicles 108 (shown in FIG. 1) such that one or more throughput parameters of the vehicles 108 traveling in the transportation network 100 (shown in FIG. 1) are maintained above a predetermined non-zero threshold. For example, the scheduling module 206 can coordinate the initial schedules such that the congestion (e.g., density per unit area over a time window) of the vehicles 108 in one or more portions of the transportation network 100 remains relatively low such that the flow of the vehicles 108 in or through the transportation network 100 is relatively high.

The scheduling system 114 can include a tracking module 208. The tracking module 208 can monitor travel of the vehicles 108 (shown in FIG. 1) in the transportation network 100 (shown in FIG. 1). The vehicles 108 may periodically report current positions of the vehicles 108 to the scheduling system 114 so that the tracking module 208 can track where the vehicles 108 are located. Alternatively, signals or other sensors disposed alongside the routes 102 (shown in FIG. 1) of the transportation network 100 can periodically report the passing of vehicles 108 by the signals or sensors to the scheduling system 114. The tracking module 208 receives the locations of the vehicles 108 in order to monitor where the vehicles 108 are in the transportation network 100 over time.

The tracking module 208 may determine the throughput parameters used by the scheduling module 206 to create and/or coordinate the schedules of the vehicles 108 (shown in FIG. 1). The tracking module 208 can calculate the throughput parameters based on the schedules of the vehicles 108 and deviations from the schedules by the vehicles 108. For example, in order to determine a statistical measure of adherence to the schedule associated with a vehicle 108, the tracking module 208 may monitor how closely the vehicle 108 adheres to the schedule as the vehicle 108 travels in the transportation network 100 (shown in FIG. 1). The vehicle 108 may adhere to the schedule of the vehicle 108 by proceeding along a path toward the scheduled destination such that the vehicle 108 will arrive at the scheduled destination at the scheduled arrival time. For example, an estimated time of arrival (ETA) of the vehicle 108 may be calculated as the time that the vehicle 108 will arrive at the scheduled destination if no additional anomalies occur that change the speed at which the vehicle 108 travels. If the ETA is the same as or within a predetermined time window of the scheduled arrival time, then the tracking module 208 may calculate a large statistical measure of adherence for the vehicle 108. As the ETA differs from the scheduled arrival time (e.g., by occurring after the scheduled arrival time), the statistical measure of adherence may decrease.

Alternatively, the vehicle 108 (shown in FIG. 1) may adhere to the schedule by arriving at or passing through scheduled waypoints of the schedule at scheduled times that are associated with the waypoints, or within a predetermined time buffer of the scheduled times. As differences between actual times that the vehicle 108 arrives at or passes through the scheduled waypoints and the associated scheduled times of the waypoints increases, the statistical measure of adherence for the vehicle 108 may decrease. Conversely, as these differences decrease, the statistical measure of adherence may increase.

The tracking module 208 may calculate the statistical measure of adherence as a time difference between the ETA of a vehicle 108 (shown in FIG. 1) and the scheduled arrival time of the schedule associated with the vehicle 108. Alternatively, the statistical measure of adherence for the vehicle 108 may be a fraction or percentage of the scheduled arrival time. For example, the statistical measure of adherence may be the fraction or percentage that the difference between the ETA and the scheduled arrival time is of the scheduled arrival time. In another example, the statistical measure of adherence may be a number of scheduled waypoints in a schedule of the vehicle 108 that the vehicle 108 arrives at or passes by later than the associated scheduled time or later than a time window after the scheduled time. Alternatively, the statistical measure of adherence may be a sum total, average, median, or other calculation of time differences between the actual times that the vehicle 108 arrives at or passes by scheduled waypoints and the associated scheduled times.

The tracking module 208 may determine the throughput parameters for the transportation network 100 (shown in FIG. 1), or a subset thereof, based on the statistical measures of adherence associated with the vehicles 108 (shown in FIG. 1). For example, a throughput parameter may be an average, median, or other statistical calculation of the statistical measures of adherence for the vehicles 108 concurrently traveling in the transportation network 100. The throughput parameter may be calculated based on the statistical measures of adherence for all, substantially all, a supermajority, or a majority of the vehicles 108 traveling in the transportation network 100.

Table 1 below provides examples of statistical measures of adherence of a vehicle 108 (shown in FIG. 1) to an associated schedule in a movement plan. Table 1 includes four columns and seven rows. Table 1 represents at least a portion of a schedule of the vehicle 108. Several tables may be calculated for different schedules of different vehicles 108 in the movement plan for the transportation network 100 (shown in FIG. 1). The first column provides coordinates of scheduled locations that the vehicle 108 is to pass through or arrive at the corresponding scheduled times shown in the second column. The coordinates may be coordinates that are unique to a transportation network 100 or that are used for several transportation networks (e.g., Global Positioning System coordinates). The numbers used for the coordinates are provided merely as examples. Moreover, information regarding the scheduled location other than coordinates may be used.

TABLE 1

| Scheduled Location (SL) | Scheduled Time | Actual Time at SL | Difference |
|---|---|---|---|
| (123.4, 567.8) | 09:00 | 09:00 | 0 |
| (901.2, 345.6) | 09:30 | 09:33 | (0:03) |
| (789.0, 234.5) | 10:15 | 10:27 | (0:12) |
| (678.9, 345.6) | 10:43 | 10:44 | (0:01) |
| (987.6, 543.2) | 11:02 | 10:58 | 0:04 |
| (109.8, 765.4) | 11:15 | 11:14 | 0:01 |
| (321.0, 987.5) | 11:30 | 11:34 | (0:04) |

The third column includes a list of the actual times that the vehicle 108 (shown in FIG. 1) arrives at or passes through the associated scheduled location. For example, each row in Table 1 includes the actual time that the vehicle 108 arrives at or passes through the scheduled location listed in the first column for the corresponding row. The fourth column in Table 1 includes a list of differences between the scheduled times in the second column and the actual times in the third column for each scheduled location.

The differences between when the vehicle 108 (shown in FIG. 1) arrives at or passes through one or more scheduled locations and the time that the vehicle 108 was scheduled to arrive at or pass through the scheduled locations may be used to calculate the statistical measure of adherence to a schedule for the vehicle 108. In one embodiment, the statistical measure of adherence for the vehicle 108 may represent the number or percentage of scheduled locations that the vehicle 108 arrived too early or too late. For example, the tracking module 208 may count the number of scheduled locations that the vehicle 108 arrives at or passes through outside of a time buffer around the scheduled time. The time buffer can be one to several minutes. By way of example only, if the time buffer is three minutes, then the tracking module 208 may examine the differences between the scheduled times (in the second column of Table 1) and the actual times (in the third column of Table 1) and count the number of scheduled locations that the vehicle 108 arrived more than three minutes early or more than three minutes late.

Alternatively, the tracking module 208 may count the number of scheduled locations that the vehicle 108 (shown in FIG. 1) arrived early or late without regard to a time buffer. With respect to Table 1, the vehicle 108 arrived at four of the scheduled locations within the time buffer of the scheduled times, arrived too late at two of the scheduled locations, and arrived too early at one of the scheduled locations.

The tracking module 208 may calculate the statistical measure of adherence by the vehicle 108 (shown in FIG. 1) to the schedule based on the number or percentage of scheduled locations that the vehicle 108 arrived on time (or within the time buffer). In the illustrated embodiment, the tracking module 208 can calculate that the vehicle 108 adhered to the schedule (e.g., remained on schedule) for 57% of the scheduled locations and that the vehicle 108 did not adhere (e.g., fell behind or ahead of the schedule) for 43% of the scheduled locations.

Alternatively, the tracking module 208 may calculate the statistical measure of adherence by the vehicle 108 (shown in FIG. 1) to the schedule based on the total or sum of time differences between the scheduled times associated with the scheduled locations and the actual times that the vehicle 108 arrived at or passed through the scheduled locations. With respect to the example shown in Table 1, the tracking module 208 may sum the time differences shown in the fourth column as the statistical measure of adherence. In the example of Table 1, the statistical measure of adherence is −15 minutes, or a total of 15 minutes behind the schedule of the vehicle 108.

In another embodiment, the tracking module 208 may calculate the average statistical measure of adherence by comparing the deviation of each vehicle 108 (shown in FIG. 1) from the average or median statistical measure of adherence of the several vehicles 108 traveling in the transportation network 100 (shown in FIG. 1). For example, the tracking module 208 may calculate an average or median deviation of the measure of adherence for the vehicles 108 from the average or median statistical measure of adherence of the vehicles 108.

The tracking module 208 can determine the throughput parameter of the transportation network 100 (shown in FIG. 1) based on the statistical measures of adherence for a plurality of the vehicles 108 (shown in FIG. 1). For example, the tracking module 208 may calculate the throughput parameter based on the statistical measure of adherence for all, substantially all, a supermajority, or a majority of the vehicles 108 traveling in the transportation network 100. In one embodiment, the tracking module 208 calculates an average or median of the statistical measures of adherence for the vehicles 108 traveling in the transportation network 100 as the throughput parameter. However, the throughput parameter may be calculated in other ways. The throughput parameter can measured as an average or median rate of throughput or rate of travel through the transportation network 100, such as an average or median rate at which the vehicles 108 travel according to the associated schedules.

In one embodiment, the scheduling module 206 may generate several different sets of potential schedules for the vehicles 108 (shown in FIG. 1) and the tracking module 208 may calculate throughput parameters associated with the different sets of the schedules. For example, the scheduling module 206 may create a set of schedules for the vehicles 104 and the tracking module 208 may simulate travel of the vehicles 108 according to the set of schedules. Based on the simulated travel, the tracking module 208 may calculate a simulated throughput parameter. The tracking module 208 may calculate additional simulated throughput parameters for additional sets of schedules. Based on a comparison between the simulated throughput parameters, the scheduling module 206 may select a set of schedules to send to the vehicles 108 for use in traveling in the transportation network 100 (shown in FIG. 1). For example, the scheduling module 206 may select the set of schedules having the largest throughput parameter, or a throughput parameter that is larger than one or more other throughput parameters associated with one or more other sets of schedules, and send the selected set of schedules to the vehicles 108.

The vehicles 108 (shown in FIG. 1) receive the schedules from the scheduling system 114 and travel in the transportation network 100 (shown in FIG. 1) in response to receiving the schedules. The vehicles 108 may encounter one or more anomalies that prevent one or more of the vehicles 108 from traveling according to the associated schedules. For example, one or more vehicles 108 may experience mechanical failure that results in cessation of movement or the need to stop for repairs. As another example, one or more vehicles 108 may travel through a section of a route 102 (shown in FIG. 1) that is damaged or is under a slow order that requires the vehicles 108 to slow down. The slowing down or stopping of the vehicles 108 can prevent the vehicles 108 from reaching the scheduled destination location at the scheduled time.

The anomalies may be detected or identified by the vehicles 108 (shown in FIG. 1). For example, the control systems 118 of the vehicles 108 (shown in FIG. 1) may detect when mechanical failure of the propulsion subsystems 122 occurs, when the vehicles 108 slow down or stop due a mechanical failure, and/or when the vehicles 108 slow down or stop movement due to damaged portions of the route 102 (shown in FIG. 1) and/or for slow orders. Alternatively, external sensors disposed alongside the routes 102 may detect mechanical failure of the vehicles 108 (e.g., hot box detectors). In one embodiment, anomalies may be reported to the scheduling system 114 by an external source, such as a third party system, an external sensor, or an operator inputting the presence of an anomaly into the scheduling system 114 (e.g., using one or more input devices such as a keyboard, touchscreen, stylus, or other device operatively coupled with the scheduling system 114). In another embodiment, the scheduling system 114 may detect the presence of an anomaly. For example, the tracking module 208 of the scheduling system 114 may determine an occurrence of an anomaly when a vehicle 108 abruptly or unexpectedly slows down or stops. The scheduling system 114 may identify an anomaly when additional vehicles 108 enter into the transportation network 100 and the initial schedules sent to the vehicles 108 were not based on the additional vehicles 108 being in the transportation network 100. The entrance of the additional vehicles 108 into the transportation network 100 may be identified based on input from an operator, data from sensors that monitor traffic in the transportation network, and the like.

The scheduling system 114 includes a resolution module 210 that modifies one or more of the schedules of the vehicles 108 (shown in FIG. 1) based on the anomaly or anomalies. For example, upon detection of an anomaly that prevents one or more of the vehicles 108 from traveling according to the initial schedules associated with the vehicles 108, the resolution module 210 can change the destination location and/or scheduled arrival time of one or more of the vehicles 108. The resolution module 210 may modify the initial schedules of the vehicles 108 to modified schedules to account for travel delays caused by the anomalies (i.e., modifying an initial schedule results in a modified schedule). For example, if an unexpected mechanical failure of a vehicle 108 and/or section of a route 102 (shown in FIG. 1), a previously unknown slow order is encountered by one or more vehicles 108, and/or one or more additional vehicles 108 enter into the transportation network 100 (shown in FIG. 1) and cause delays that prevent the vehicles 108 from arriving at the destination locations at the initially scheduled arrival times, the resolution module 210 may change the destination locations to different locations and/or the arrival times to later times.

The resolution module 210 can modify the initial schedules based on one or more factors. In one embodiment, the resolution module 210 changes the initial schedules to the modified schedules based on simulated throughput parameters of the transportation network 100 (shown in FIG. 1). For example, the resolution module 210 may modify the initial schedules while maintaining one or more throughput parameters of the transportation network 100 above a predetermined, non-zero threshold. For example, the resolution module 210 may generate different sets of modified schedules. The tracking module 208 may simulate travel of the vehicles 108 (shown in FIG. 1) in the transportation network 100 according to the modified schedules and with the identified anomalies in the transportation network 100. As described above, the tracking module 208 can calculate simulated throughput parameters associated with the different sets of modified schedules. The resolution module 210 may compare the simulated throughput parameters and, based on the comparison, select a set of modified schedules. The modified schedules in the selected set are communicated to the vehicles 108 so that the vehicles 108 can travel according to the modified schedules.

The resolution module 210 can modify the initial schedules based on fuel efficiencies of the vehicles 108 (shown in FIG. 1). For example, the resolution module 210 may compare the fuel efficiencies of the vehicles 108 and delay the scheduled arrival times of the vehicles 108 by different amounts of time based on the fuel efficiency of the vehicles 108, or how much fuel the different vehicles 108 consume while traveling. In one embodiment, the resolution module 210 may delay the previously scheduled arrival time for a first vehicle 108 by a greater amount compared to a second vehicle 108 when the first vehicle 108 is more fuel efficient, or consumes less fuel than the second vehicle 108 to travel over the same or a common route 102 (shown in FIG. 1). Conversely, the resolution module 210 may delay the scheduled arrival times for less fuel-efficient vehicles 108 by lesser amounts of time relative to delays for more fuel-efficient vehicles 108.

Delaying the scheduled arrival times of the more fuel-efficient vehicles 108 by greater amounts than the less-fuel efficient vehicles 108 can result in consuming less total fuel by the vehicles 108. For example, delaying the scheduled arrival time of a vehicle 108 increases the amount of time that the vehicle 108 is consuming fuel to move toward the scheduled destination location at the delayed arrival time. As the amount of time that a less fuel-efficient vehicle 108 is consuming fuel increases, the vehicle 108 consumes more fuel relative to a more fuel-efficient vehicle 108.

Modifying the schedule of one or more vehicles 108 (shown in FIG. 1) may impact the travel of one or more other vehicles 108 concurrently traveling in the transportation network 100 (shown in FIG. 1). For example, delaying a scheduled arrival time of a first vehicle 108 that passes a second vehicle 108 in a meet event (e.g., where the first and second vehicles 108 are traveling in opposite directions) or a pass event (e.g., where the first and second vehicles 108 are traveling in the same direction) at a siding section 104 (shown in FIG. 1) may cause the first vehicle 108 to arrive too late to the meet event or pass event. As a result, the resolution module 210 may also modify the schedules of one or more other vehicles 108 based on the modification of the schedule of a first vehicle 108. The other vehicles 108 whose schedules are modified may be identified by the resolution module 210 by determining which of the other vehicles 108 have schedules that will cause the vehicles 108 to intersect the route of the first vehicle 108 and/or interact with the first vehicle 108 (e.g., pass the first vehicle 108, be passed by the first vehicle 108, converge onto a common section of the routes 102 with the first vehicle 108 from two separate sections of the routes 102, diverge with the first vehicle 108 from a common section of the routes 102 to two separate sections of the routes 102, or the like). The resolution module 210 can identify the other vehicles 108 and determine which of the other vehicles 108 interact with the first vehicle 108 and modify the schedules of the other vehicles 108 accordingly. For example, the resolution module 210 may modify the schedules of several vehicles 108 concurrently traveling in the transportation network 100 in order to maintain the throughput parameter of the transportation network 100 above a predetermined, non-zero threshold.

The resolution module 210 conveys the modified schedules to the scheduling module 206 so that the scheduling module 206 can transmit the modified schedules to the vehicles 108 (shown in FIG. 1). In one embodiment, the scheduling module 206 transmits the modified schedules to the corresponding vehicles 108 having the schedules that are modified. Alternatively, the scheduling module 206 may transmit a plurality of the modified schedules to one or more of the vehicles 108.

The control systems 118 of the vehicles 108 (shown in FIG. 1) receive the modified schedules sent by the scheduling system 114. In the illustrated embodiment, the control system 118 of a vehicle 108 includes a controller 212, such as a computer processor or other logic-based device that performs operations based on one or more sets of instructions (e.g., software). The instructions on which the controller 212 operates may be stored on a tangible and non-transitory (e.g., not a transient signal) computer readable storage medium, such as a memory 214. The memory 214 may include one or more computer hard drives, flash drives, RAM, ROM, EEPROM, and the like. Alternatively, one or more of the sets of instructions that direct operations of the controller 212 may be hard-wired into the logic of the controller 212, such as by being hard-wired logic formed in the hardware of the controller 212.

The control system 118 includes several modules that perform various operations described herein. The modules are shown as being included in the controller 212. As described above, the modules may include hardware and/or software systems that operate to perform one or more functions, such as the controller 212 and one or more sets of instructions. Alternatively, one or more of the modules may include a controller that is separate from the controller 212.

The control system 118 receives the schedules from the scheduling system 114. The controller 212 may be operatively coupled with the antenna 120 to receive the initial and/or modified schedules from the scheduling system 114. In one embodiment, the schedules are conveyed to an energy management module 204 of the control system 118 that is disposed on-board a vehicle 108 (shown in FIG. 1). In another embodiment, the energy management module 204 may be disposed off-board the vehicle 108 (shown in FIG. 1) for which the trip plan is formed. For example, the energy management module 204 can be disposed in a central dispatch or other office that generates the trip plans for one or more vehicles 108.

The energy management module 204 receives the schedule sent from the scheduling system 114 and generates a trip plan based on the schedule. As described above, the trip plan may include throttle settings, brake settings, designated speeds, or the like, of the vehicle 108 for various sections of a scheduled trip of the vehicle 108 to the scheduled destination location. The trip plan may be generated to reduce the amount of fuel that is consumed by the vehicle 108 as the vehicle 108 travels to the destination location relative to travel by the vehicle 108 to the destination location when not abiding by the trip plan.

In order to generate the trip plan for the vehicle 108 (shown in FIG. 1), the energy management module 204 can refer to a trip profile that includes information related to the vehicle 108, information related to the route 102 (shown in FIG. 1) over which the vehicle 108 travels to arrive at the scheduled destination, and/or other information related to travel of the vehicle 108 to the scheduled destination location at the scheduled arrival time. The information related to the vehicle 108 may include information regarding the fuel efficiency of the vehicle 108 (e.g., how much fuel is consumed by the vehicle 108 to traverse different sections of a route 102), the tractive power (e.g., horsepower) of the vehicle 108, the weight or mass of the vehicle 108 and/or cargo, the length and/or other size of the vehicle 108, the location of the powered units 110 (shown in FIG. 1) in the vehicle 108 (e.g., front, middle, back, or the like of a vehicle consist having several mechanically interconnected units 110, 112), or other information. The information related to the route 102 to be traversed by the vehicle 108 can include the shape (e.g., curvature), incline, decline, and the like, of various sections of the route 102, the existence and/or location of known slow orders or damaged sections of the route 102, and the like. Other information can include information that impacts the fuel efficiency of the vehicle 108, such as atmospheric pressure, temperature, and the like.

The trip plan is formulated by the energy management module 204 based on the trip profile. For example, if the trip profile requires the vehicle 108 to traverse a steep incline and the trip profile indicates that the vehicle 108 is carrying significantly heavy cargo, then the energy management module 204 may form a trip plan that includes or dictates increased tractive efforts to be provided by the propulsion subsystem 122 of the vehicle 108. Conversely, if the vehicle 108 is carrying a smaller cargo load and/or is to travel down a decline in the route 102 based on the trip profile, then the energy management module 204 may form a trip plan that includes or dictates decreased tractive efforts by the propulsion subsystem 122 for that segment of the trip. In one embodiment, the energy management module 204 includes a software application or system such as the Trip Optimizer™ system provided by General Electric Company.

The control system 118 includes a control module 216 that generates control signals for controlling operations of the vehicle 108 (shown in FIG. 1). The control module 216 may receive the trip plan from the energy management module 204 and generate the control signals that automatically change the tractive efforts and/or braking efforts of the propulsion subsystem 122 based on the trip plan. For example, the control module 216 may form the control signals to automatically match the speeds of the vehicle 108 with the speeds dictated by the trip plan for various sections of the trip of the vehicle 108 to the scheduled destination location. Alternatively, the control module 216 may form control signals that are conveyed to an output device 218 disposed on-board the vehicle 108. The output device 218 can visually and/or audibly present instructions to an operator of the vehicle 108 to change the tractive efforts and/or braking efforts of the vehicle 108 based on the control signals. For example, the output device 218 can visually present textual instructions to the operator to increase or decrease the speed of the vehicle 108 to match a designated speed of the trip plan.

The energy management module 204 can generate an initial trip plan for an initial schedule formed by the scheduling system 114. As described above, an initial trip plan may not be limited to just the first trip plan generated for a vehicle 108 (shown in FIG. 1). For example, an initial trip plan can include any trip plan that is later modified by the control system 118, and may not necessarily be the first trip plan created for a vehicle 108.

The vehicles 108 (shown in FIG. 1) may travel according to the initial trip plans for the vehicles 108 until one or more anomalies occur and/or are detected. As described above, when the scheduling system 114 identifies an anomaly that prevents one or more vehicles 108 from traveling to the corresponding scheduled destination locations at the scheduled arrival times, the scheduling system 114 may modify the initial schedules of one or more of the vehicles 108 to modified schedules for the one or more vehicles 108. When the modified schedules are transmitted to the control systems 118 of the vehicles 108, the energy management modules 204 may form modified trip plans based on the modified schedules.

For example, an initial trip plan for a vehicle 108 (shown in FIG. 1) may be generated to cause the vehicle 108 to travel to a scheduled destination at a scheduled arrival time. The anomaly or anomalies may prevent the vehicle 108 from arriving at the scheduled destination at the scheduled arrival time and, as a result, the modified schedule provides a different destination location and/or arrival time for the vehicle 108. The energy management module 204 may generate a modified trip plan based on the destination location and/or arrival time of the modified schedule. The vehicle 108 may proceed to the destination location of the modified schedule according to the modified trip plan. As described above, the trip plan (including the initial and/or modified trip plan) may cause the vehicle 108 to travel to the destination location while reducing the amount of fuel consumed by the vehicle 108 to travel to the destination location.

In one embodiment, the tracking module 208 of the scheduling system 114 may continue to monitor movement (e.g., locations and associated times) of the vehicles 108 (shown in FIG. 1) traveling according to the modified schedules in the transportation network 100 (shown in FIG. 1). The tracking module 208 can monitor movements of the vehicles 108 to determine one or more throughput parameters of the transportation network 100 and/or to determine if an additional anomaly occurs (e.g., by abrupt, unexpected, or unplanned changes in movements of the vehicles 108).

In one embodiment, the resolution module 210 changes one or more of the modified schedules of the vehicles 108 after an anomaly is removed. For example, if an anomaly that caused the resolution module 210 to change one or more initial schedules of the vehicles 108 to first modified schedules is removed from the transportation network 100 (shown in FIG. 1), repaired, or otherwise corrected or eliminated, then the resolution module 210 may again change the first modified schedules of one or more of the vehicles 108 to second modified schedules. The second modified schedules may include updated destination locations and/or arrival times that are based on an absence of the anomaly.

Figure 3:
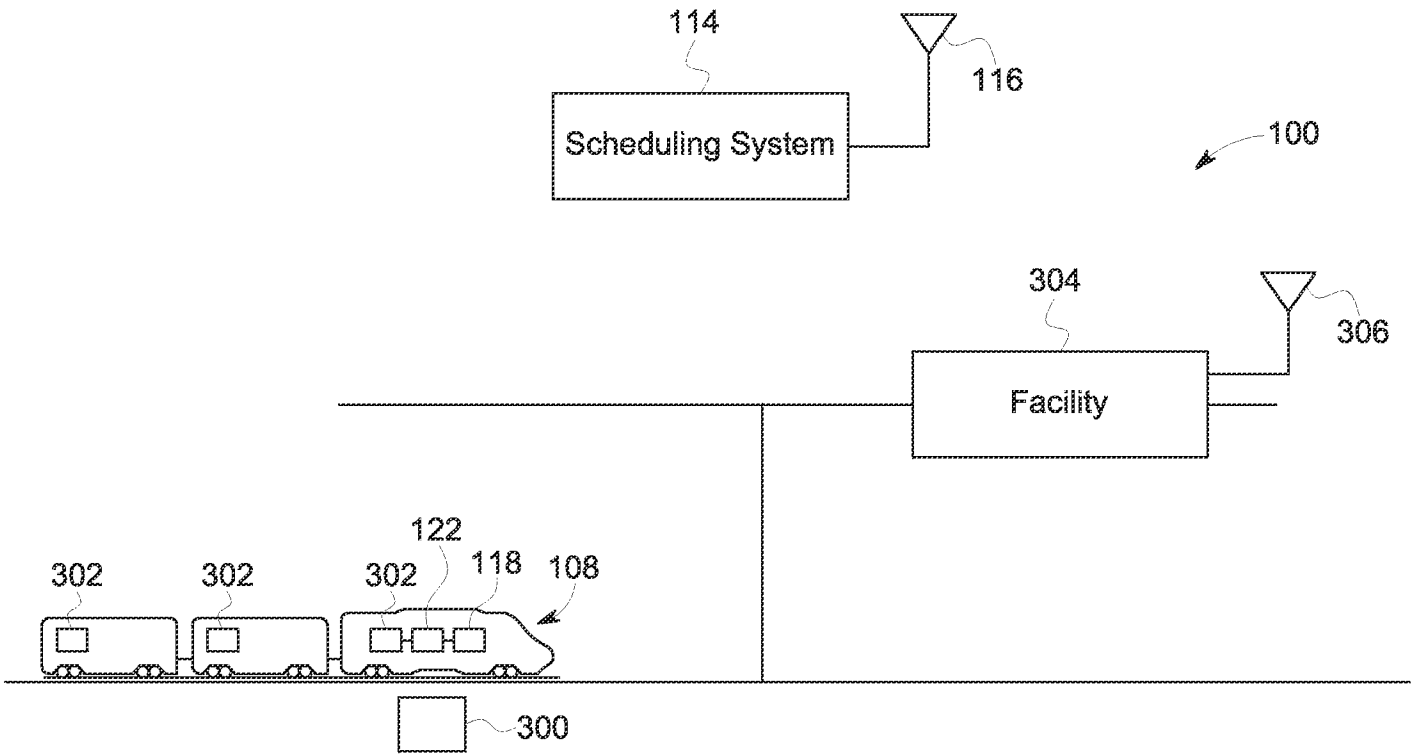
FIG. 3 is another schematic diagram of a portion of the transportation network shown in FIG. 1 in accordance with one embodiment.

FIG. 3 is another schematic diagram of a portion of the transportation network 100 shown in FIG. 1 in accordance with one embodiment. As described above, anomalies in the transportation network 100 may be identified or detected by the scheduling system 114, by the vehicles 108, and/or by off-board sensors 300. With respect to the scheduling system 114, an operator may use an input device to inform the scheduling system 114 of an anomaly. The operator may inform the scheduling system 114 of the location and/or duration of the anomaly. The scheduling system 114 can then determine which initial schedules of the vehicles 108 are impacted by the anomaly and change the initial schedules into the modified schedules, as described above. In another example, the scheduling system 114 may monitor the movements of vehicles 108 in the transportation network 100 and, based on the movements, determine that an anomaly exists. The movements may indicate an anomaly when an unexpected or unplanned change in the movement of one or more vehicles 108 in the transportation network 100 change or deviate from the schedules of the vehicles 108.

With respect to the vehicles 108, one or more on-board sensors 302 may be disposed on-board the vehicles 108 to detect anomalies related to the vehicles 108 (e.g., mechanical failure or characteristics of operation that indicate an impending mechanical failure). The on-board sensors 302 can monitor operational characteristics of the vehicle 108 to determine if an anomaly related to the vehicle 108 occurs. For example, motor current signature analysis may be performed on-board the vehicles 108 to determine if a bearing, axle, or other component of the vehicle 108 has failed or is tending toward failure. A temperature sensor may determine if an engine or motor of the vehicle 108 is overheating or tending toward overheating. Other types of sensors may be used as the on-board sensor 302. If the characteristic being monitored by an on-board sensor 302 exceeds or falls below one or more thresholds, then the characteristic may indicate that an anomaly has occurred or is about to occur.

The control system 118 may periodically poll the sensors 302 and/or the sensors 302 may periodically report the monitored characteristics of the vehicle 108 to the control system 118. In another example, the sensors 302 may report the characteristics to the control system 118 when the characteristics indicate an anomaly (e.g., exceed or fall below a threshold) or a trend toward occurrence of an anomaly (e.g., the monitored characteristics are increasing or decreasing over time toward a threshold indicative of an anomaly). The control system 118 may generate an output signal that represents detection of the anomaly. For example, the control module 216 (shown in FIG. 2) may generate the output signal that indicates one or more characteristics of the vehicle 108 indicate an anomaly.

The control system 118 may transmit the output signal to one or more recipients, such as the scheduling system 114 and/or a facility 304 disposed off-board the vehicle 108. For example, the control system 118 may wirelessly transmit the output signal to the antenna 116 of the scheduling system 114 or to an antenna 306 of the facility 304. The scheduling system 114 can receive the output signal to determine that an anomaly has occurred or is likely to occur and can modify one or more schedules of the vehicles 108, as described above.

In one embodiment, the facility 304 is a maintenance facility that repairs the vehicle 108. The facility 304 may receive the output signal and determine that the vehicle 108 is in need of repair or maintenance. The facility 304 can generate notifications to operators working at the facility 304 that the vehicle 108 is in need of repair or maintenance. The scheduling system 114 may modify the schedule of the vehicle 118 to arrive at the facility 304. For example, the schedule of the vehicle 108 may be modified such that the destination location is the location of the facility 304 and the arrival time is a scheduled appointment for the vehicle 108 to be repaired. The scheduling system 114 can transmit the modified schedule to both the vehicle 108 and the facility 304 so that the vehicle 108 travels to the facility 304 for repair and so that the facility 304 knows when to expect the vehicle 108.

With respect to the off-board sensors 300, one or more of the sensors 300 may be disposed off-board the vehicles 108 and alongside the routes 102 in the transportation network 100 to detect anomalies related to the vehicles 108 and/or the route. The off-board sensors 300 can monitor operational characteristics of the vehicle 108 to determine if an anomaly related to the vehicle 108 occurs. For example, the off-board sensors 300 can include a hot box detector disposed alongside the route 102 to monitor axle, bearing, and/or wheel temperatures of the vehicle 108 as the vehicle 108 passes the off-board sensor 300. As another example, the off-board sensors 300 can measure characteristics of the route 102 (e.g., resistivity and/or conductivity of a railroad track) to determine if the route 102 is broken or otherwise in need of repair. If the characteristic being monitored by an off-board sensor 300 exceeds or falls below one or more thresholds, then the characteristic may indicate that an anomaly has occurred or is about to occur.

The scheduling system 114 may periodically poll the off-board sensors 300 and/or the off-board sensors 300 may periodically report the monitored characteristics to the scheduling system 114. In another example, the off-board sensors 300 may report the characteristics to the scheduling system 114 when the characteristics indicate an anomaly or a trend toward occurrence of an anomaly. The scheduling system 114 may generate and transmit an alert signal when the anomaly is detected (e.g., when the characteristics representative of the anomaly or a trend toward an anomaly are received). For example, the tracking module 208 (shown in FIG. 2) may create a data signal representative of the type of anomaly (e.g., related to the vehicle 108 and/or the route 102), the location of the anomaly, and/or a duration of the anomaly (e.g., how long the anomaly has lasted or is expected to last).

The alert signal is transmitted to one or more recipients, such as the facility 304. As described above, in one embodiment, the scheduling system 114 can modify the schedule of the vehicle 108 and notify the facility 304 via the alert signal such that the vehicle 108 proceeds to the facility 304 for repair. As another example, the scheduling system 114 may transmit the alert signal to the facility 304 such that the location of an anomaly related to the route 102 is identified to the facility 304. The facility 304 can then arrange for one or more persons and/or equipment to go to the location to repair the route 102 or otherwise remove or correct the anomaly.

Figure 4:
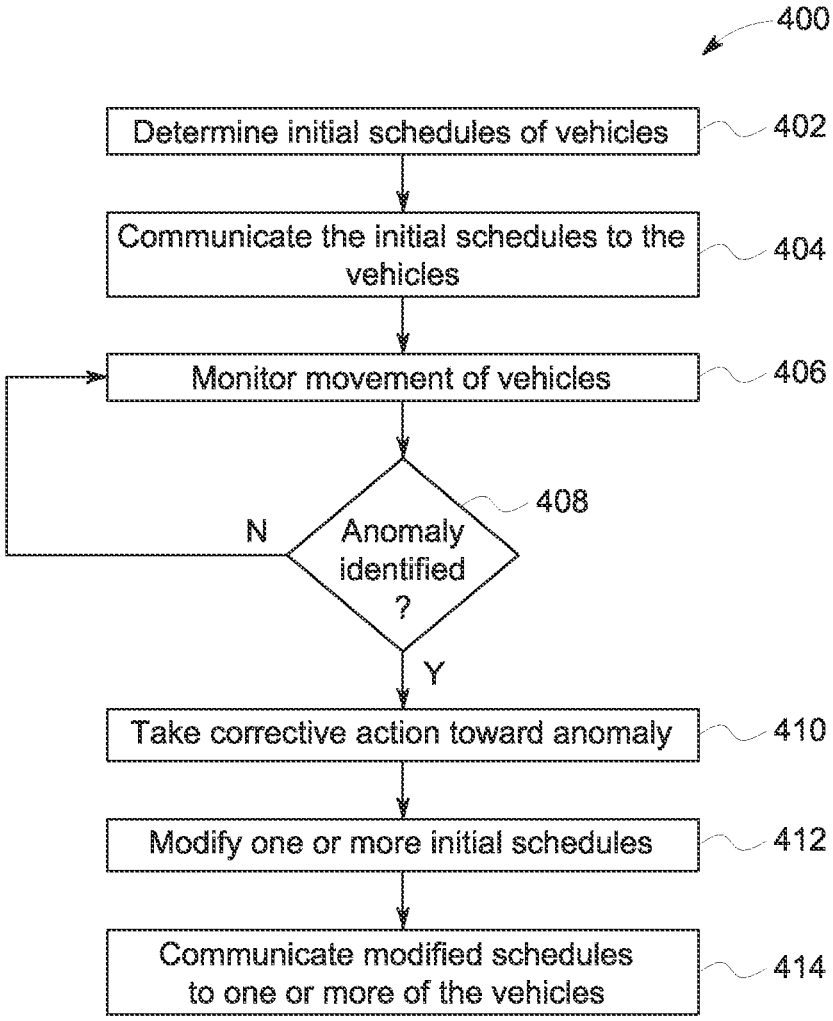
FIG. 4 is a flowchart of one embodiment of a method for modifying schedules of vehicles traveling in a transportation network.

FIG. 4 is a flowchart of one embodiment of a method 400 for modifying schedules of vehicles traveling in a transportation network. The method 400 may be used in conjunction with one or more of the systems described herein, such as the scheduling system 114 (shown in FIG. 1).

At 402, initial schedules of a plurality of vehicles 108 (shown in FIG. 1) that are to travel concurrently in the transportation network 100 (shown in FIG. 1) are determined. As described above, the scheduling system 114 (shown in FIG. 1) may determine the initial schedules to maintain a throughput parameter of the transportation network 100 above a threshold.

At 404, the initial schedules are communicated to the vehicles 108 (shown in FIG. 1). The initial schedules may be wirelessly transmitted to the antennas 120 (shown in FIG. 1) of the vehicles 108. Alternatively, the initial schedules may be transmitted to the vehicles 108 by one or more other media, such as through a conductive pathway (e.g., a railroad track, overhead catenary, or other wire or bus). As described above, the control systems 118 (shown in FIG. 1) may generate initial trip plans based on the initial schedules. The vehicles 108 may travel through the transportation network 100 (shown in FIG. 1) according to the initial trip plans.

At 406, movement of the vehicles 108 (shown in FIG. 1) is monitored. For example, locations and/or associated times at which the vehicles 108 are located may be tracked to monitor where the vehicles 108 are located.

At 408, a determination is made as to whether one or more anomalies are identified in the transportation network 100 (shown in FIG. 1). As described above, an anomaly may include an anomaly related to operation of one or more vehicles 108 (shown in FIG. 1), related to one or more routes 102 (shown in FIG. 1) of the transportation network 100, and/or related to one or more additional vehicles entering into or passing through the transportation network 100. Also as described above, the identified anomaly may prevent one or more of the vehicles 108 from traveling in the transportation network 100 according to the initial schedules of the vehicles 108.

If an anomaly is detected, then the schedules of one or more of the vehicles 108 (shown in FIG. 1) may need to be modified to account for the anomaly. As a result, flow of the method 400 proceeds to 410. On the other hand, if an anomaly is not detected, then the flow of the method 400 may return to 406 where movement of the vehicles 108 continues to be monitored.

In one embodiment, at 410, one or more corrective actions are taken to remove or otherwise remediate the detected anomaly. For example, an output signal or an alert signal may be transmitted to the facility 304 (shown in FIG. 3) so that repair of the vehicle 108 (shown in FIG. 1) and/or route 102 (shown in FIG. 1) can be scheduled, prepared for, and/or performed.

At 412, one or more of the initial schedules of the vehicles 108 (shown in FIG. 1) are modified to account for the anomaly. For example, the scheduling system 114 (shown in FIG. 1) may select a different destination location and/or a different arrival time for one or more of the vehicles 108 due to the type, duration, and/or location of the anomaly. The scheduling system 114 can form modified schedules for the vehicles 108 based on the anomaly.

At 414, the modified schedules are communicated to the vehicles 108 (shown in FIG. 1). For example, the modified schedules may be transmitted to the corresponding vehicles 108. As described above, the vehicles 108 may form modified trip plans based on the modified schedules and travel in the transportation network 100 (shown in FIG. 1) based on the modified trip plan.

In one embodiment, movement of the vehicles 108 (shown in FIG. 1) continues to be monitored. If the anomaly is repaired, corrected, or otherwise removed from the transportation network 100 (shown in FIG. 1), then the modified schedules of the vehicles 108 may be modified again based on the absence of the anomaly from the transportation network 100, as described above. In another embodiment, if an additional anomaly is detected, then the modified schedules may be modified again to account for the additional anomaly.

Figure 5:
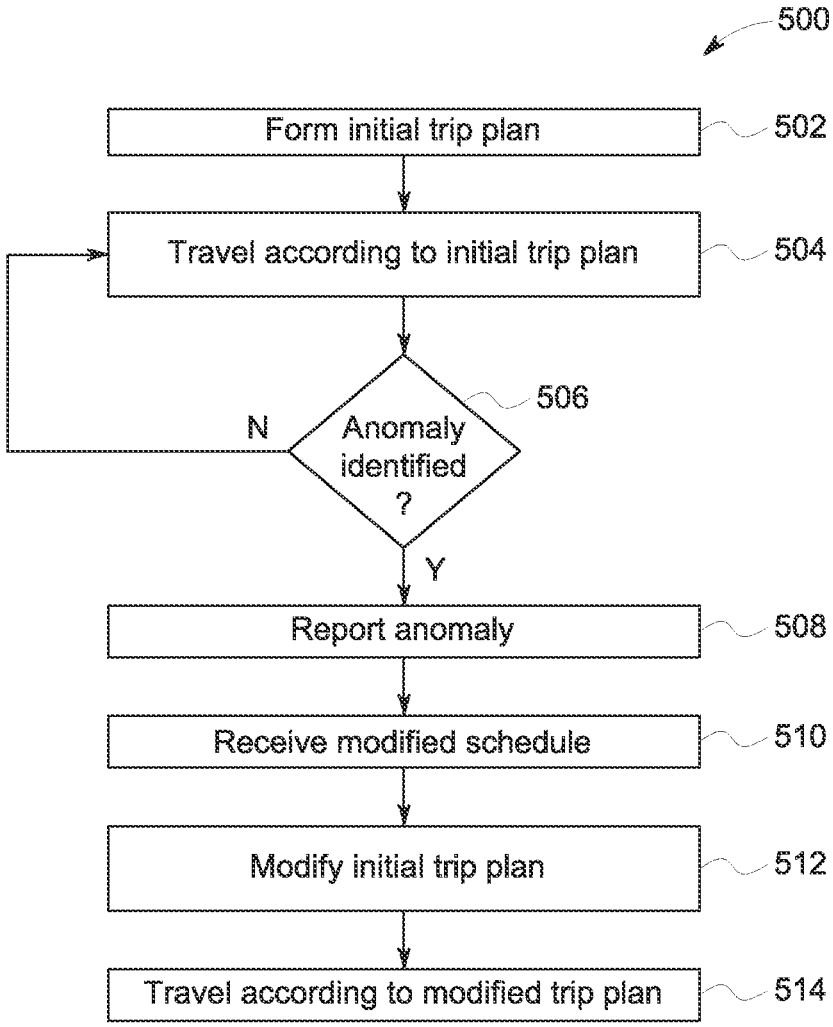
FIG. 5 is a flowchart of one embodiment of a method for traveling in a transportation network.

FIG. 5 is a flowchart of one embodiment of a method 500 for traveling in a transportation network. The method 500 may be used in conjunction with one or more of the systems described herein, such as the control system 118 (shown in FIG. 1). The method 500 is described herein as being performed by a control system 118 of a single vehicle 108 (shown in FIG. 1), but may be concurrently performed by a plurality of control systems 118 in a plurality of vehicles 108 concurrently traveling in the transportation network 100 (shown in FIG. 1).

At 502, an initial trip plan is formed. The initial trip plan may be created based on an initial schedule received from the scheduling system 114 (shown in FIG. 1). As described above, the initial trip plan may dictate tractive efforts, braking efforts, speeds, or the like, of the vehicle 108 (shown in FIG. 1) for various sections of a trip to a scheduled destination location. The trip plan can be based on a variety of information, including information related to the vehicle 108, the route 102 (shown in FIG. 1) along which the vehicle 108 will travel to get to the destination location, and/or other information.

At 504, the vehicle 108 (shown in FIG. 1) travels toward the destination location of the initial schedule according to the initial trip plan. Traveling according to the initial trip plan may result in the vehicle 108 consuming less fuel than the vehicle 108 would consume if the vehicle 108 traveled according to a different plan. In one embodiment, control signals are generated based on the initial trip plan. The control signals may automatically change settings of the propulsion subsystem 122 (shown in FIG. 1) of the vehicle 108 and/or may be used to generate instructions to an operator so that the operator can manually change the settings of the propulsion subsystem 122. The settings of the propulsion subsystem 122 are changed so that the vehicle 108 travels according to the initial trip plan.

At 506, a determination is made as to whether one or more anomalies are identified in the transportation network 100 (shown in FIG. 1). As described above, an anomaly may include an anomaly related to operation of one or more vehicles 108 (shown in FIG. 1), related to one or more routes 102 (shown in FIG. 1) of the transportation network 100, and/or related to one or more additional vehicles entering into or passing through the transportation network 100. Also as described above, the identified anomaly may prevent one or more of the vehicles 108 from traveling in the transportation network 100 according to the initial schedules of the vehicles 108. One or more on-board sensors 302 disposed on-board the vehicle 108 may detect an anomaly or a trend in operating characteristics of the vehicle 108 that indicate the potential for an anomaly related to the vehicle 108 to occur while the vehicle 108 travels to the destination location.

If an anomaly is detected, then the schedule of the vehicle 108 (shown in FIG. 1) may be modified to account for the anomaly, as described above. If the schedule of the vehicle 108 is modified, then the initial trip plan also may need to be updated to account for a different destination location and/or arrival time of the modified schedule. In one embodiment, the anomaly may be detected by a component other than the vehicle 108. For example, another vehicle 108, an off-board sensor 300, or another person or component may identify or detect the anomaly and report the anomaly to the scheduling system 114 (shown in FIG. 1). As a result, flow of the method 500 proceeds to 508.

On the other hand, if an anomaly is not detected, then the flow of the method 500 may return to 504 where the vehicle 108 continues to move toward the scheduled destination location according to the initial trip plan.

In one embodiment, at 508, the anomaly is reported to an off-board location. For example, if the vehicle 108 (shown in FIG. 1) detects the anomaly, such as an on-board sensor 302 (shown in FIG. 3) detecting the anomaly, then the presence of the anomaly may be communicated to the scheduling system 114 (shown in FIG. 1) and/or the facility 304 (shown in FIG. 3). As described above, the anomaly may be reported so that the schedules of one or more vehicles 108 may be modified and/or so that one or more corrective actions may be taken to repair, correct, or otherwise remove the anomaly from the transportation network 100 (shown in FIG. 1).

At 510, a modified schedule is received. As described above, one or more of the initial schedules of the vehicles 108 (shown in FIG. 1) may be modified to account for the anomaly.

At 512, the trip plan of the vehicle 108 (shown in FIG. 1) is modified based on the modified schedule. For example, the initial trip plan may be changed because the destination location and/or arrival time of the modified schedule differs from the initial schedule and initial trip plan. The initial trip plan may be changed into the modified trip plan while the vehicle 108 is moving toward the destination location of the initial schedule or the modified schedule. The vehicle 108 may travel at a current throttle setting and/or brake setting, or at a default throttle setting and/or brake setting, while the initial trip plan is changed to the modified trip plan.

At 514, the vehicle 108 (shown in FIG. 1) travels to the destination location of the modified schedule based on the modified trip plan. As described above, the modified trip plan may dictate tractive efforts, braking efforts, speeds, or the like, of the vehicle 108 (shown in FIG. 1) as the vehicle 108 travels toward the destination location of the modified schedule. Also as described above, the schedule and/or trip plan of the vehicle 108 may be modified more than once as the vehicle 108 travels toward the destination location due to the detection of additional anomalies and/or the removal of previously identified anomalies from the transportation network 100 (shown in FIG. 1).

In one embodiment, a system includes a scheduling module and a resolution module. The scheduling module is configured to determine plural initial schedules for plural different vehicles to concurrently travel in a transportation network formed from a plurality of interconnected routes. The initial schedules include one or more locations and associated times for the vehicles to travel along the routes of the transportation network. The resolution module is configured to modify at least one of the initial schedules to one or more modified schedules based on an anomaly in at least one of the vehicles or the routes that prevents one or more of the vehicles from traveling in the transportation network according to one or more of the initial schedules associated with the one or more of the vehicles. The scheduling module is configured to communicate the one or more modified schedules to one or more of the vehicles so that energy management systems disposed on the one or more of the vehicles modify travel of the one or more vehicles in the transportation network according to the one or more modified schedules.

In another aspect, the resolution module is configured to modify the at least one of the initial schedules based on the anomaly that includes a mechanical failure of the at least one of the vehicles or the routes.

In another aspect, the resolution module is configured to modify the at least one of the initial schedules based on the anomaly that includes one or more additional vehicles entering into the transportation network and the initial schedules are based on the additional vehicles being absent from the transportation network. For example, the initial schedules may be created with the expectation or assumption that the additional vehicles are not in the transportation network when the vehicles associated with the initial schedules travel in the transportation network. Alternatively, the existence of the additional vehicles may be unknown when the initial schedules are created. Then, when the additional vehicles enter into the transportation network and the vehicles with the initial schedules are impacted or may be impacted by the additional vehicles, the initial schedules may be modified to account for the additional vehicles, such as by changing paths, schedules times, destination locations, and the like, of the initial schedules, as described above.

In another aspect, the scheduling module is configured to, responsive to receiving information of the anomaly, communicate an alert signal to a maintenance facility that provides for at least one of repair, correction, or removal of the anomaly from the transportation network.

In another aspect, the resolution module is configured to receive an output signal from at least one of the vehicles that identifies the anomaly in the transportation network.

In another aspect, the resolution module is configured to identify a location of the anomaly in the transportation network based on the output signal.

In another aspect, the output signal includes information representative of one or more of a change in tractive efforts of the at least one of the vehicles, or a change in braking efforts of the at least one of the vehicles.

In another aspect, the output signal includes a notification that the at least one of the vehicles will arrive at a destination location of the initial schedule associated with the at least one of the vehicles later than an initially scheduled time.

In another aspect, the resolution module is configured to modify at least one of the initial schedules by changing one or more of a destination location or a time at which at least one of the vehicles associated with the at least one of the initial schedules is to arrive at the destination location.

In another aspect, the system also includes a tracking module configured to monitor changing locations of the vehicles in the transportation network based on at least the modified schedules of the vehicles.

In another aspect, the resolution module is configured to modify the at least one of the initial schedules to maintain a throughput parameter of the transportation network above a non-zero threshold. The throughput parameter includes a measure of adherence by the vehicles to the modified schedules as the vehicles concurrently move through the transportation network.

In another aspect, the resolution module is configured to change one or more of the modified schedules when the anomaly is removed from the transportation network and communicate the one or more modified schedules that are changed to one or more of the vehicles.

In another aspect, the scheduling module is configured to determine the initial schedules and the resolution module is configured to modify the initial schedules for rail vehicle consists traveling in the transportation network formed from interconnected tracks.

In another embodiment, another system includes an energy management module and a communication module. The energy management module is configured to generate an initial trip plan for a control unit of a first vehicle. The initial trip plan is based on an initial schedule of travel for the first vehicle in a transportation network formed from a plurality of interconnected routes. The initial trip plan is used by the control unit to control tractive efforts of the first vehicle in the transportation network. The communication module is configured to receive a modified schedule for travel of the first vehicle in the transportation network. The modified schedule is based on discovery of an anomaly in the transportation network that prevents the first vehicle from traveling in the transportation network according to the initial schedule. The energy management module is configured to change the initial trip plan to a modified trip plan based on the modified schedule and communicate the modified trip plan to the control unit to change the tractive efforts of the first vehicle.

In another aspect, the energy management module is configured to form at least one of the initial trip plan or the modified trip plan to reduce an amount of fuel consumed by the first vehicle to travel in the transportation network according to the corresponding initial schedule or the modified schedule relative to traveling in the transportation network according to a different schedule.

In another aspect, the energy management module is configured to generate the initial trip plan based on a destination location and a time at which the vehicle is to arrive at the destination location according to the initial schedule.

In another aspect, the energy management module is configured to change the initial trip plan to the modified trip plan by modifying at least one of the destination location or the time associated with the destination location.

In another aspect, the energy management module is configured to change the initial trip plan when the first vehicle discovers the anomaly in the transportation network and prior to the communication module receiving the modified schedule.

In another aspect, the communication module is configured to transmit an output signal to an off-board network scheduling system to notify the scheduling system of the anomaly when the first vehicle discovers the anomaly.

In another aspect, the communication module is configured to notify the network scheduling system of the anomaly that includes at least one of a mechanical failure of one or more other vehicles traveling in the transportation network, a mechanical failure of one or more of the routes of the transportation network, or entry of one or more other vehicles into the transportation network.

In another aspect, the communication module is configured to notify the network scheduling system of the anomaly by transmitting the output signal to the network scheduling system.

In another aspect, the output signal includes information representative of a change in the tractive efforts of the first vehicle or a change in braking efforts of the first vehicle.

In another aspect, the output signal includes a notification that the first vehicle will arrive at a destination location of the initial schedule later than an initially scheduled time.

In another aspect, the energy management module and the communication module are configured to be disposed onboard a rail vehicle consist traveling in the transportation network formed from interconnected tracks.

In another aspect, the energy management module is configured to change the modified trip plan when the anomaly is removed from the transportation network.

In another embodiment, a method includes determining plural initial schedules for plural different vehicles to concurrently travel in a transportation network formed from a plurality of interconnected routes. The initial schedules include one or more locations and associated times for the vehicles to travel along the routes of the transportation network. The method also includes identifying an anomaly in at least one of the vehicles or the routes that prevents one or more of the vehicles from traveling in the transportation network according to one or more of the initial schedules associated with the one or more of the vehicles and modifying at least one of the initial schedules to one or more modified schedules based on an anomaly. The method further includes communicating the one or more modified schedules to one or more of the vehicles so that energy management systems disposed on the one or more of the vehicles modify travel of the one or more vehicles in the transportation network according to the one or more modified schedules.

In another aspect, the method also includes communicating the initial schedules to the vehicles, and wherein modifying the at least one of the initial schedules occurs after the initial schedules are communicated to the vehicles.

In another aspect, identifying the anomaly includes one or more of: identifying a mechanical failure of the at least one of the vehicles or the routes or determining when one or more additional vehicles enter into the transportation network when the initial schedules are based on an absence of the additional vehicles from the transportation network.

In another aspect, the method also includes communicating an alert signal to a maintenance facility that provides for at least one of repair, correction, or removal of the anomaly from the transportation network.

In another aspect, the method also includes determining a location of the anomaly in the transportation network based on an output signal from at least one of the vehicles.

In another aspect, the output signal includes information representative of one or more of a change in tractive efforts of the at least one of the vehicles, a change in braking efforts of the at least one of the vehicles, or a notification that the at least one of the vehicles will arrive at a destination location of the initial schedule associated with the at least one of the vehicles later than an initially scheduled time.

In another aspect, modifying the at least one of the initial schedules includes forming the one or more modified schedules such to maintain a throughput parameter of the transportation network above a threshold. The throughput parameter includes a measure of adherence by the vehicles to the modified schedules as the vehicles concurrently move through the transportation network.

In another aspect, determining the initial schedules includes forming the initial schedules and modifying the at least one of the initial schedules includes changing the at least one of the initial schedules for rail vehicle consists traveling in the transportation network formed from interconnected tracks.

In another embodiment, another method includes generating an initial trip plan for a control unit of a first vehicle. The initial trip plan is based on an initial schedule of travel for the first vehicle in a transportation network formed from a plurality of interconnected routes. The initial trip plan is used by the control unit to control tractive efforts of the first vehicle in the transportation network. The method also includes receiving a modified schedule for travel of the first vehicle in the transportation network. The modified schedule is based on discovery of an anomaly in the transportation network that prevents the first vehicle from traveling in the transportation network according to the initial schedule. The method further includes changing the initial trip plan to a modified trip plan based on the modified schedule. The modified trip plan used by the control unit to change the tractive efforts of the first vehicle.

In another aspect, generating the initial trip plan or changing the initial trip plan includes forming the initial trip plan or the modified trip plan to reduce an amount of fuel consumed by the first vehicle to travel in the transportation network according to the corresponding initial schedule or modified schedule relative to traveling in the transportation network according to a different schedule.

In another aspect, the method also includes transmitting an output signal to an off-board network scheduling system to notify the scheduling system of the anomaly when the first vehicle discovers the anomaly.

In another aspect, transmitting the output signal includes communicating the output signal that includes information representative of a change in the tractive efforts of the first vehicle, a change in braking efforts of the first vehicle, or a notification that the first vehicle will arrive at a destination location of the initial schedule later than an initially scheduled time.

In another aspect, generating the initial trip plan and changing the initial trip plan include forming the initial trip plan and the modified trip plan for a rail vehicle consist traveling in the transportation network formed from interconnected tracks.

Embodiments of the invention relate to transportation network systems for scheduling and controlling vehicles (e.g., rail vehicles) travelling in the network. An off-board scheduling system (e.g., located at a central dispatch office) generates a movement schedule for plural vehicles in the network. For each vehicle, the movement schedule includes at least one destination and arrival time; the schedule may also include a designated route. The schedule is generated based on information of the network currently known to the scheduling system at the time the schedule is generated. The scheduling system communicates to the schedule to the plural vehicles. Based in part on the received schedule, each vehicle generates a trip plan. The trip plan is generated by an on-board energy management system, taking into account the schedule, vehicle characteristics, route characteristics, and one or more objectives, such as saving fuel or reducing emissions (versus controlling the vehicle not using the trip plan). The trip plan may be configured for control of the vehicle as described above, e.g., it establishes throttle or other vehicle traction control settings for a plurality of points along the route, as a function of time and/or location.

Each vehicle is controlled along its respective route according to its respective trip plan. During travel, upon the occurrence and detection of an anomaly in the transportation network: (i) a vehicle trip plan may be re-planned (resulting in a modified trip plan) based on the anomaly; and/or (ii) the schedule may be re-scheduled, resulting in a modified schedule. In one aspect, the scheduling system is appraised of the anomaly before a vehicle, in which case the scheduling system generates a modified schedule, communicates the modified schedule to the vehicle, and the vehicle generates a modified trip plan, based on the modified schedule, for subsequent control of the vehicle. In another aspect, the vehicle is aware of the anomaly before receiving a modified schedule that takes into account the anomaly (and for this purpose, modified schedules may be communicated to include information about the anomaly or other reason for the modified schedule), and: (i) immediately generates a modified trip plan based on the anomaly, communicates the anomaly to the scheduling system, and generates a new modified trip plan if a modified schedule is received from the scheduling system that necessitates or warrants a new modified trip plan; or (ii) does not immediately generate a modified trip plan, but instead communicates the anomaly to the scheduling system, and generates a modified trip plan when a modified schedule is received from the scheduling system.

Thus, in an embodiment, a method for controlling a vehicle comprises a step of receiving at the vehicle an initial schedule from an off-board scheduling system, and generating an initial trip plan based in part on the initial schedule. The vehicle is controlled along a route according to the initial trip plan. The method further comprises generating a modified trip plan of the initial trip plan whenever a modified schedule is received from the scheduling system, and when the vehicle detects an anomaly associated with its travel. The method further comprises communicating the anomaly from the vehicle to the scheduling system. The method may further comprise generating the modified trip plan based on operational information of the vehicle, i.e., information relating to the vehicle in operation. In another embodiment, the method further comprises communicating information associated with a modified trip plan to the scheduling system whenever a vehicle generates a modified trip plan. In another embodiment, a modified trip plan or modified schedule is generated only if an anomaly meets one or more designated criteria. In another embodiment, different criteria are established for generating modified trip plans and generating modified schedules, that is, certain events may warrant generating a modified trip plan but not a modified schedule, and vice versa.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter, including the best mode, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A system comprising:

a scheduling module configured to determine plural initial schedules for plural different vehicles to concurrently travel in a transportation network formed from a plurality of interconnected routes, the initial schedules including one or more locations and associated times for the vehicles to travel along the routes of the transportation network; and a resolution module configured to receive, from at least one of the vehicles, an identification of an anomaly of at least one of the routes or the at least one of the vehicles that prevents one or more of the vehicles from traveling in the transportation network according to one or more of the initial schedules associated with the one or more of the vehicles, and to modify, responsive to receiving the identification, at least one of the initial schedules to one or more modified schedules based on the anomaly;

wherein the scheduling module is configured to communicate the one or more modified schedules to one or more of the vehicles so that energy management systems disposed on the one or more of the vehicles modify travel of the one or more vehicles in the transportation network according to the one or more modified schedules.

2. The system of claim 1, wherein the anomaly comprises one or more characteristics of operation of the at least one of the vehicles indicating an impending mechanical failure related to the at least one of the vehicles.

3. The system of claim 1, wherein the resolution module is configured to modify the at least one of the initial schedules based on the anomaly that includes one or more additional vehicles entering into the transportation network and the initial schedules are based on the additional vehicles being absent from the transportation network.

4. The system of claim 1, wherein responsive to receiving information of the anomaly, the scheduling module is configured to communicate an alert signal to a maintenance facility that provides for at least one of repair, correction, or removal of the anomaly from the transportation network.

5. The system of claim 1, wherein the resolution module is configured to receive an output signal from the at least one of the vehicles that identifies the anomaly in the transportation network.

6. The system of claim 5, wherein the resolution module is configured to identify a location of the anomaly in the transportation network based on the output signal.

7. The system of claim 6, wherein the output signal includes information representative of one or more of a change in tractive efforts of the at least one of the vehicles or a change in braking efforts of the at least one of the vehicles.

8. The system of claim 6, wherein the output signal includes a notification that the at least one of the vehicles will arrive at a destination location of the initial schedule associated with the at least one of the vehicles later than an initially scheduled time.

9. The system of claim 1, wherein the resolution module is configured to modify at least one of the initial schedules by changing one or more of a destination location or a time at which at least one of the vehicles associated with the at least one of the initial schedules is to arrive at the destination location.

10. The system of claim 1, further comprising a tracking module configured to monitor changing locations of the vehicles in the transportation network based on at least the modified schedules of the vehicles.

11. The system of claim 1, wherein the resolution module is configured to modify the at least one of the initial schedules to maintain a throughput parameter of the transportation network above a non-zero threshold, the throughput parameter including a measure of adherence by the vehicles to the modified schedules as the vehicles concurrently move through the transportation network.

12. The system of claim 1, wherein the resolution module is configured to change one or more of the modified schedules when the anomaly is removed from the transportation network and communicate the one or more modified schedules that are changed to one or more of the vehicles.

13. The system of claim 1, wherein the scheduling module is configured to determine the initial schedules and the resolution module is configured to modify the initial schedules for rail vehicle consists traveling in the transportation network formed from interconnected tracks.

14. A system comprising:

an energy management module configured to generate an initial trip plan for a control unit of a first vehicle, the energy management module configured to be disposed on-board the first vehicle, the initial trip plan based on an initial schedule of travel for the first vehicle in a transportation network formed from a plurality of interconnected routes, the initial trip plan used by the control unit to control tractive efforts of the first vehicle in the transportation network;

a sensor configured to be disposed on-board the first vehicle and configured to detect an anomaly in the transportation network that prevents the first vehicle from traveling in the transportation network according to the initial schedule; and a communication module configured to provide an identification of the anomaly to an off-board network scheduling system, and to receive a modified schedule for travel of the first vehicle in the transportation network, the modified schedule based on the anomaly, wherein the energy management module is configured to change the initial trip plan to a modified trip plan based on the modified schedule and communicate the modified trip plan to the control unit to change the tractive efforts of the first vehicle.

15. The system of claim 14, wherein the energy management module is configured to form at least one of the initial trip plan or the modified trip plan to reduce an amount of fuel consumed by the first vehicle to travel in the transportation network according to the corresponding initial schedule or the modified schedule relative to traveling in the transportation network according to a different schedule.

16. The system of claim 14, wherein the energy management module is configured to generate the initial trip plan based on a destination location and a time at which the vehicle is to arrive at the destination location according to the initial schedule.

17. The system of claim 16, wherein the energy management module is configured to change the initial trip plan to the modified trip plan by modifying at least one of the destination location or the time associated with the destination location.

18. The system of claim 14, wherein the energy management module is configured to change the initial trip plan when the first vehicle discovers the anomaly in the transportation network and prior to the communication module receiving the modified schedule.

19. The system of claim 14, wherein the communication module is configured to transmit an output signal to the off-board network scheduling system to notify the scheduling system of the anomaly when the first vehicle discovers the anomaly.

20. The system of claim 19, wherein the anomaly includes a mechanical failure of the first vehicle.

21. The system of claim 19, wherein the anomaly comprises one or more characteristics of operation of the at least one of the vehicles indicating an impending mechanical failure related to the at least one of the vehicles.

22. The system of claim 19, wherein the output signal includes information representative of one or more of a change in the tractive efforts of the first vehicle or a change in braking efforts of the first vehicle.

23. The system of claim 19, wherein the output signal includes a notification that the first vehicle will arrive at a destination location of the initial schedule later than an initially scheduled time.

24. The system of claim 14, wherein the energy management module and the communication module are configured to be disposed on-board a rail vehicle consist traveling in the transportation network formed from interconnected tracks.

25. The system of claim 14, wherein the energy management module is configured to change the modified trip plan when the anomaly is removed from the transportation network.

26. A method comprising:

determining plural initial schedules for plural different vehicles to concurrently travel in a transportation network formed from a plurality of interconnected routes, the initial schedules including one or more locations and associated times for the vehicles to travel along the routes of the transportation network;

identifying, on-board at least one of the vehicles, an anomaly in the at least one of the vehicles or the routes that prevents one or more of the vehicles from traveling in the transportation network according to one or more of the initial schedules associated with the one or more of the vehicles;

communicating an identification of the anomaly from the at least one of the vehicles to an off-board scheduling system;

modifying at least one of the initial schedules to one or more modified schedules based on an anomaly; and communicating the one or more modified schedules to one or more of the vehicles so that energy management systems disposed on the one or more of the vehicles modify travel of the one or more vehicles in the transportation network according to the one or more modified schedules.

27. The method of claim 26, further comprising communicating the initial schedules to the vehicles, and wherein modifying the at least one of the initial schedules occurs after the initial schedules are communicated to the vehicles.

28. The method of claim 26, wherein identifying the anomaly includes one or more of: identifying a mechanical failure of the at least one of the vehicles or the routes or determining when one or more additional vehicles enter into the transportation network when the initial schedules are based on an absence of the additional vehicles from the transportation network.

29. The method of claim 26, further comprising communicating an alert signal to a maintenance facility that provides for at least one of repair, correction, or removal of the anomaly from the transportation network.

30. The method of claim 26, further comprising determining a location of the anomaly in the transportation network based on an output signal from at least one of the vehicles.

31. The method of claim 26, wherein modifying the at least one of the initial schedules includes forming the one or more modified schedules such to maintain a throughput parameter of the transportation network above a threshold, the throughput parameter including a measure of adherence by the vehicles to the modified schedules as the vehicles concurrently move through the transportation network.

32. The method of claim 26, wherein determining the initial schedules includes forming the initial schedules and modifying the at least one of the initial schedules includes changing the at least one of the initial schedules for rail vehicle consists traveling in the transportation network formed from interconnected tracks.

33. A method comprising:

generating an initial trip plan for a control unit of a first vehicle, the initial trip plan based on an initial schedule of travel for the first vehicle in a transportation network formed from a plurality of interconnected routes, the initial trip plan used by the control unit to control tractive efforts of the first vehicle in the transportation network;

identifying, on-board the first vehicle, an anomaly in at least one of the first vehicle or the routes that prevents the first vehicle from traveling in the transportation network according to the initial schedule;

communicating an identification of the anomaly from the first vehicle to an off-board scheduling system;

receiving, from the off-board scheduling system, a modified schedule for travel of the first vehicle in the transportation network, the modified schedule based on the anomaly in the transportation network that prevents the first vehicle from traveling in the transportation network according to the initial schedule; and changing the initial trip plan to a modified trip plan based on the modified schedule, the modified trip plan used by the control unit to change the tractive efforts of the first vehicle.

34. The method of claim 33, wherein generating the initial trip plan or changing the initial trip plan includes forming the initial trip plan or the modified trip plan to reduce an amount of fuel consumed by the first vehicle to travel in the transportation network according to the corresponding initial schedule or modified schedule relative to traveling in the transportation network according to a different schedule.

35. The method of claim 33, wherein the anomaly comprises one or more characteristics of operation of the at least one of the vehicles indicating an impending mechanical failure related to the at least one of the vehicles.

36. The method of claim 33, wherein communicating the identification of the anomaly comprises communicating an output signal that includes information representative of a change in the tractive efforts of the first vehicle, a change in braking efforts of the first vehicle, or a notification that the first vehicle will arrive at a destination location of the initial schedule later than an initially scheduled time.

37. The method of claim 33, wherein generating the initial trip plan and changing the initial trip plan include forming the initial trip plan and the modified trip plan for a rail vehicle consist traveling in the transportation network formed from interconnected tracks.

* * * * *